United States Patent [19]

Ohsima et al.

[11] Patent Number: 4,903,841

[45] Date of Patent: Feb. 27, 1990

[54] POUCH WITH SUPERPOSED TEAR LINES

[75] Inventors: Shigeyuki Ohsima, Nakano; Yoshiji Moteki, Saitama, both of Japan

[73] Assignee: Kabushiki Kaisha Hosokawa Yoko, Tokyo, Japan

[21] Appl. No.: 271,792

[22] Filed: Nov. 16, 1988

[30] Foreign Application Priority Data

Sep. 29, 1988 [JP] Japan ..... 63-127646[U]

[51] Int. Cl.[4] ..... B65D 17/28

[52] U.S. Cl. ..... 206/604; 206/610

[58] Field of Search ..... 206/604, 610

[56] References Cited

U.S. PATENT DOCUMENTS

| | | | |
|---|---|---|---|
| 465,562 | 4/1987 | Christoff et al. . | |
| 477,858 | 10/1988 | Yamazaki et al. . | |
| 2,333,587 | 11/1942 | Salfisberg . | |
| 2,923,404 | 2/1960 | Adell . | |
| 3,146,912 | 9/1964 | Twersky . | |
| 3,172,443 | 3/1965 | Ausnit . | |
| 3,181,583 | 5/1965 | Lingenfelter . | |
| 3,226,787 | 1/1966 | Ausnit . | |
| 3,272,424 | 9/1966 | Rodkey . | |
| 3,323,707 | 6/1967 | King . | |
| 3,473,589 | 10/1969 | Gotz . | |
| 3,616,990 | 11/1971 | Powell . | |
| 3,619,395 | 11/1971 | Skendzic . | |
| 3,625,351 | 12/1971 | Ersenberg | 206/604 |
| 3,679,511 | 7/1972 | Ausnit . | |
| 3,685,645 | 8/1972 | Kawaguchi . | |
| 3,799,914 | 3/1974 | Schmit et al. | 206/604 |
| 3,827,472 | 8/1974 | Uramato . | |
| 4,479,244 | 10/1984 | Ausnit . | |
| 4,498,591 | 2/1985 | Smith, II . | |
| 4,543,279 | 9/1985 | Kai | 206/604 |
| 4,570,820 | 2/1986 | Murphy . | |
| 4,589,145 | 5/1986 | Van Erden et al. . | |
| 4,598,826 | 7/1986 | Shinbach . | |
| 4,615,045 | 9/1986 | Siegel . | |
| 4,630,311 | 12/1986 | Bentson . | |
| 4,744,674 | 5/1988 | Nocek . | |
| 4,759,643 | 7/1988 | Canno . | |
| 4,777,054 | 10/1988 | Greenhouse . | |
| 4,778,058 | 10/1988 | Yamazaki et al. | 206/610 |
| 4,785,937 | 11/1988 | Tamezawa et al. . | |
| 4,786,190 | 11/1988 | Van Erden et al. . | |
| 4,832,505 | 5/1989 | Ausnit et al. . | |
| 4,834,245 | 5/1989 | Ohga et al. . | |

FOREIGN PATENT DOCUMENTS

| | | |
|---|---|---|
| 0109965 | 6/1984 | European Pat. Off. . |
| 1112446 | 8/1961 | Fed. Rep. of Germany . |
| 1088564 | 10/1967 | United Kingdom . |
| WO87/02968 | 5/1987 | World Int. Prop. O. . |

*Primary Examiner*—Stephen P. Garbe

*Attorney, Agent, or Firm*—Sughrue, Mion, Zinn, Macpeak & Seas

[57] ABSTRACT

A pouch formed of a laminate sheet for containing therein a content such as retort food. Both lateral sides of front and rear walls of the pouch are heat sealed with each other, and top opening is also heat sealed together to sealingly maintain the content. The laminate sheet has at least two heat sealable plastic layers at an inner side of the pouch. At at least one of the heat sealable plastic layers, a surface roughened zones are provided at both front and wear walls. The zones are superposed together and extend along a tearing direction staring from a notch formed at one side heat sealed portion.

8 Claims, 1 Drawing Sheet

POUCH WITH SUPERPOSED TEAR LINES

BACKGROUND OF THE INVENTION

The present invention relates to a pouch for sealingly containing retort food which is easily tearable for discharging the food.

A laminate sheet is conventionally used as a material of a pouch for containing a retort food. The laminate sheet includes a laminate film formed of plastic material layers, and an aluminum foil joined or deposited thereto for enhancing breakage strength and moisture-blocking function. The laminate film has a base substrate formed of a material selected from the group consisting of polypropylene, nylon and polyester, and the film is biaxially oriented film.

Generally, a rectangular laminate sheet is folded into two sections in order to define front and rear walls, and confronting three side edge portions are heat sealed together to obtain a bag shape. Such pouch is ordinarily referred to as a "pillow type" pouch. Alternatively, two identical rectangular laminate sheets are prepared serving as the front and rear walls, and these are superposed together, and are joined at four side edge portions.

The laminate sheet of this type has high breaking strength, and therefore, it would be rather difficult to tear the pouch at the heat sealed portion so as to discharge a content packed therein. To overcome this problem, V-shaped or I-shaped notch is formed at at least one heat sealed portion in order to facilitate the tearing.

Still however, since the laminate sheet has sufficient breaking strength, it would be still difficult to align the tearing locus at the front wall with the tearing locus at the rear wall, even if tearing is initiated from the V-shaped or I-shaped notch. After tearing the pouch at the heat sealed zone, the tearing locus at a front wall of the pouch would be different from the tearing locus at the rear wall thereof. As a result, food or content may be disadvantageously flooded from the tearing opening. For example, if user only draw his attention to the front tearing line, the content may be leaked out of the rear tearing line, if the rear line is not coincident with the front line, but is positioned lower than the front line.

Another proposal has been made to overcome the above described drawback. According to the proposal, a base substrate film which also functions as heat sealing layer formed of non-oriented polypropylene is formed over an aluminum film, and linear slits are formed at the base substrate film so as to facilitate tearing. However, it would be rather difficult to align a slit at the front wall of the pouch will a slit at the rear wall thereof, and resultant pouch does not provide sufficient impact strength. Further, the aluminum foil may be directly contacted with the content which will pass through the slits of the heat sealing layer, and therefore, corrosion may occur in the aluminum foil.

SUMMARY OF THE INVENTION

It is therefore, an object of the present invention to overcome the above described prior art drawbacks and disadvantages, and to provide an improved pouch for containing a food or other content.

Another object of this invention is to provide such pouch which has sufficient sealability yet easily tearable for discharging the content.

According to this invention, there is provided a pouch for containing a content, the pouch including a rectangular front wall and a rectangular rear wall having identical shape with the front wall, at least three heat sealed sections having a first side heat seal portion heat sealed together at one confronting side edge portions of the front and rear walls, a second side heat seal portion heat sealed together at another confronting side edge portions of the front and rear walls, and a top heat sealed portion heat sealed together at confronting top edge portions of the front and wear walls, the improvement comprising: the front and rear walls being formed of a laminate sheet comprising a plastic film layer, a content blockage layer formed over the plastic film layer, and an aluminum foil, one of the plastic film layer and the content blockage layer being bonded to the aluminum foil; the first side heat seal portion being formed with a notch; and the plastic film layer of the front and rear walls being formed with first and second surface roughened zones each extending from the first side heat seal portion to the second side heat seal portion in parallel with the top heat seal portion, each one ends of the surface roughened zones being in alignment with the notch and the first and second surface roughened zones being superposed with each other.

Upon initiating the tearing at the notch, the pouch can be torn along the surface roughened zones to the another side seal portion. During this tearing, the front and rear tearing lines are aligned with each other, so that the content can be preserved in the pouch. Further, since the content blockage layer is provided, the aluminum foil is not subjected to corrosion due to contact with the content which may pass through minute holes at the surface roghened zone.

DETAILED DESCRIPTION OF THE INVENTION

One embodiment according to this invention will be described with reference to accompanying drawings.

Figure 1:
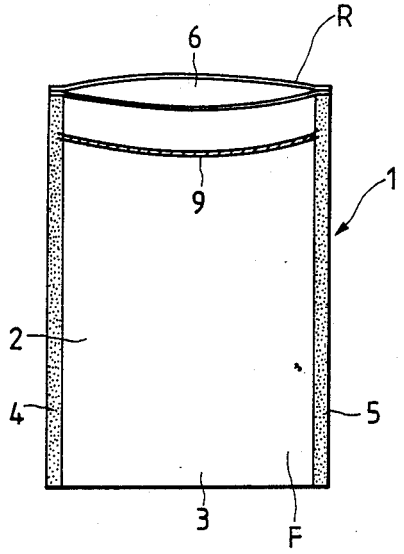
FIG. 1 is a schematic front view showing a pillow type pouch in which a top opening is not heat sealed according to this invention.
Figure 2:
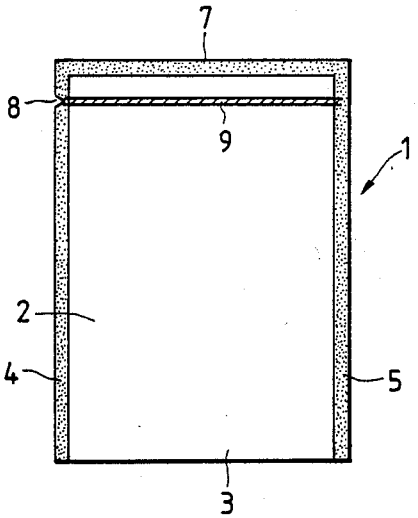
FIG. 2 is a front view showing the pillow type pouch in which a top opening is heat sealed according to this invention.

A pillow type pouch prior to filling a content or product therein is shown in FIG. 1. The pillow type pouch 1 is formed of a laminate sheet 2 and includes a rectangular front wall F, a rectangular rear wall R having a shape identical with the front wall, a bottom portion 3, which is a folding line (23 in FIG. 4), a first side heat sealed portion or seam 4, a second side heat sealed portion or seam 5, and a top opening 6. Confronting side edge portions of the front and rear walls are heat sealed together to provide the first and second side heat sealed portions 4 and 5. These side heat sealed portions are heat sealed by an ordinary heat sealing device. Further, as shown in FIG. 2, confronting top edges are also heat sealed together to provide a top heat sealed portion or seam 7 after the content is filled in the pouch through the top opening 6.

A notch 8 is formed at the first side heat sealed portion 4 at a position adjacent the top heat sealed portion 6. According to the present invention, a surface roughened zone 9 having a small width is provided at inner surfaces of the front and rear wall F and R. The surface roughened zone 9 extends from the notch 8 to the second side heat sealed portion 5 in parallel with the top heat sealed portion 7.

Figure 3:
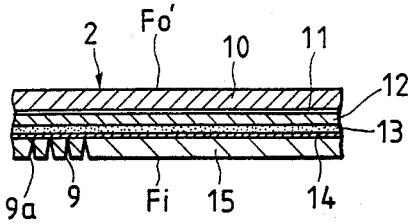
FIG. 3 is a cross-sectional view showing a laminate sheet used as the pouch according to this invention; and, FIG. 4 is a plan view showing a rectangular laminate sheet prior to heat sealing for constructing the pillow type pouch according to this invention.

As shown in FIG. 3, the laminate film 2 includes a polyester film layer 10 having a thickness of 12 microns and serving as an external surface layer Fo, and adhesive layer 11, an aluminum foil 12 having a thickness of 9 microns, an adhesive resin layer 13, a first cast polypropylene film layer 14 having a thickness of 15 microns, and a second cast polypropylene film layer 15 having a thickness of 50 microns and serving as an inner surface Fi. The first cast polypropylene film layer 14 serves as a content blockage layer described later. At the second cast polypropylene film layer 15, the surface roughened portion 9 is formed. The adhesive layer 11 serves to bond the outer layer 10 to the alumninum foil 12, and the adhesive resin layer 13 serves to bond the first cast polypropylene film layer 14 to the aluminum foil 12. Further, the second cast polypropylene film layer 15 serves as the heat sealed material. The surface roughened portion 9 is formed with surface scored lines 9*a* each extending in directions parallel with the extending direction of the zone 9. The scored lines 9*a* can be formed mechanically. For example, the cast polypropylene film layer 15 is subjected to knurling by a roller formed with a plurality of circumferentially extending projections. Alternatively, perforated score lines(s) is also available to provide the surface roughened portion. After the one surface Fi of the innermost layer 15 is subjected to scoring, he first cast polypropylene layer 14 is joined to another surface (flat surface) of the innermost layer 15 by extrusion molding. Therefore, the polypropylene layer has a total thickness of 65 microns, and non-scored layer 14 is interposed between the aluminum layer 12 and the scored layer 15.

Figure 4:
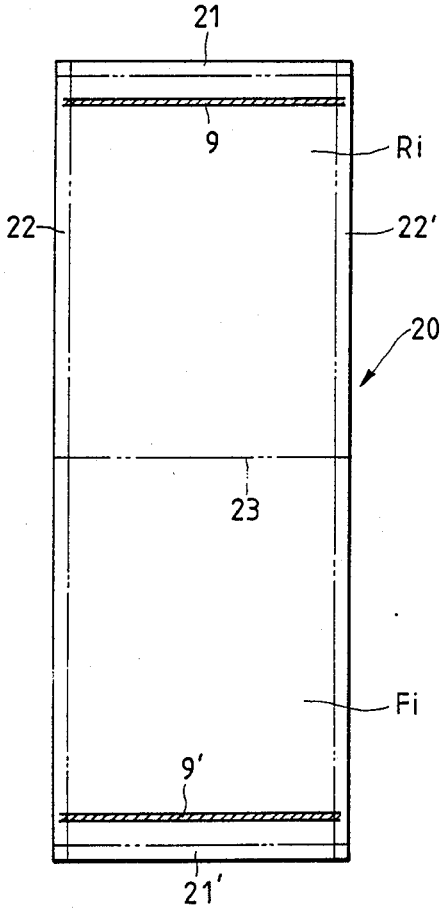

A production of such pouch will next be described with reference to FIG. 4. Firstly, an elongated rectangular laminate sheet 20 is prepared. The sheet has a length twice as large as a length of the resultant pouch and a width equal to that of the resultant pouch, and a foldable line 23 is defined at a central portion of the sheet 20. One longitudinal edge portion 22 serves as the first heat sealed portion 4, and another longitudinal edge portion 22′ serves as the second heat sealed portion 5. Further, end edges 21 and 21′ serve as the top heat sealed portion 7. Upon folding the rectangular laminate sheet 20 at the folding line 23, these edge portions confront with each other. Further, a pair of surface roughened portion 9, 9′ are formed at positions close to the end edges 21 and 21′, respectively. The roughened portion 9, 9′ extend in parallel with the end edges 21, 21′. Each one end of the roughened portions is provided even at the one longitudinal edge portion 22, and each another end of the roughened portions is provided even at the other longitudinal edge portion 22′. Of course, the surface roughened portions 9 and 9′ are superposed together when folding the elongated sheet 20.

Then, after the elongated sheet 20 is foled into two sections F and R at the foldable line 23, confronting longitudinal edge portions 22 and 22′ are heat sealed to provide a bag shaped configuration. In this case, the surface roughned portions 9 and 9′ confront with each other. Thereafter the notch 8 is formed at the first side heat sealed portion 4 at a position in alignment with the surface roughened portion 9 and 9′. Then, a content is filled into the bag shaped pouch through the top opening 6, and thereafter, the top opening is also heat sealed together at the zones 21 and 21′.

For taking out the content, user grips both sides of the notch 8 and pulls the first side heat sealed portion 4 in opposite directions with respect to the notch 8. As a result, tearing occurs at the notch portion 8 and is propagated along the surface roughened portion 9 which is contiguous with the notch. This tearing is easily and continuously propagated to the second side heat sealed portion 5, because of the formation of the surface roughened portion 9 reaching thereto. In this case, since the surface roughened portion 9′ at the front wall F is in alignment with the surface roughened portion 9 at the rear wall R, tearing lines at the front and rear walls are also aligned with each other, and accordingly, no inadvertent content flooding occurs.

Further, even if the scored lines 9*a* penetrate the second cast polypropylene film layer 15 in thickness direction and the internal content is entered into the scored holes, (if perforated scored lines are formed to form the surface roughened portion 9, such penetration does occur), the content does not reach the aluminum foil 12 since the intermedate first cast polypropylene layer 14 (content blockage layer) is interposed between the aluminum foil 12 and the innermost layer 15. Accordingly, even if the content is stored in the pouch for a long period of time, corrosion of the aluminum foil 12 by the contact with the content never occurs, which in turn, can maintain the content in stabilized quality for a long duration of time.

In the above described embodiment, the pillow type pouch is described. However, four side seal pouch is also available in the present invention wherein two identically shaped laminate sheets are superposed together and heat sealed together. Further, in the above described embodiment, the scored lines 9*a* are in direct contact with the content packed in the pouch. However, it would be also possible to bond the scored layer directly to the aluminum foil, and the above mentioned first cast polypropylene 14 is functioned as the innermost layer in contact with the content.

In view of the foregoing, according to the present invention, the tearing position has already been determined by the surface roughened portion 9 and 9′ which have mechanical strength smaller than the non roughened portion, and these surface roughened portions 9 and 9′ are superposed with each other. Therefore, the pouch is easily tearable along the surface roubhened portions. Further, the tearing line at the front wall of the pouch is also superposed with the tearing line at the rear wall thereof, so that inadvertant flooding of content is avoidable. Furthermore, the additional cast polypropylene film 14 can prevent the content from reaching the aluminum foil through the scored portions. Therefore, corrosion of aluminum foil is avoidable, to thus maintain the content in stabilized quality for a long period of time.

While the invention has been described in detail and with reference to specific embodiment thereof, it would be apparent for those skilled in the art that various chages and modifications can be made therein without departing from the spirit and scope of the invention.

What is claimed is:

1. A pouch for containing a product, said pouch including a rectangular front wall and a rectangular rear wall having a shape identical with said front wall, at least three heat sealed sections including a first side seam (4) sealing together confronting side edges of said front and rear walls, a second side seam (5) sealing together opposite confronting side edges of said front and rear walls, and a top seam (7) sealing together confronting top edges of said front and rear walls, wherein:

said front and rear walls are formed of a laminate sheet comprising a plastic film layer (15), a product blockage layer (14) formed over said plastic film layer, and an aluminum foil (12), one of said plastic film layer and said product blockage layer being bonded to said aluminum foil;

said first side seam is formed with a notch (8); and said plastic film layer of said front and rear walls is formed with first and second surface roughened zones (9) each extending from said first side seam to said second side seam in parallel with said top seam, one end of each of said surface roughened zones being in alignment with said notch, and said first and second surface roughened zones being superposed with each other.

2. The pouch as defined in claim 1, wherein said first and second surface roughened zones are formed with spaced, parallel score lines (9*a*).

3. The pouch as claimed in claim 1, wherein each of said first and second surface roughened zones are provided with perforated score lines.

4. The pouch as claimed in claim 1, wherein said blockage layer comprises a first cast polypropylene film, and wherein said plastic film layer comprises a second cast polypropylene film.

5. The pouch as claimed in claim 4, wherein said plastic film layer is positioned at an inner side of said pouch in contact with said product, and said product blockage layer is interposed between said plastic film layer and said aluminum foil.

6. The pouch as claimed in claim 4, wherein said product blockage layer is positioned at an inner side of said pouch in contact witth said product, and said plastic film layer is interposed between said product blockage layer and said aluminum foil.

7. The pouch as claimed in claim 5, wherein said plastic film layer is formed of a heat fusable material.

8. The pouch as claimed in claim 5, wherein said product blockage layer is formed of a heat fusable material.

* * * * *